US005873641A

United States Patent [19]

Spinelli

[11] Patent Number: 5,873,641

[45] Date of Patent: Feb. 23, 1999

[54] FOOD CASE LINER

[76] Inventor: Larry Spinelli, 7544 Vinnedge Rd., Hamilton, Ohio 45011

[21] Appl. No.: 602,369

[22] Filed: Feb. 16, 1996

[51] Int. Cl.[6] ..... A47F 3/04

[52] U.S. Cl. ..... 312/114; 312/114; 312/116; 312/128; 312/140.1; 312/140.3; 312/140.4; 428/195; 428/196

[58] Field of Search ..... 312/114, 116, 312/128, 140.1, 140.4, 140.3; 428/195, 196

[56] References Cited

U.S. PATENT DOCUMENTS 1,390,812 9/1921 Ottenheimer .
1,426,747 8/1922 Lasher .
2,279,945 4/1942 Hoffman .
2,863,302 12/1958 Morris .
3,850,486 11/1974 Saxe .
4,324,962 4/1982 Dulen .
4,416,120 11/1983 Yono et al. .
5,133,088 7/1992 Dunlap .

*Primary Examiner*—Jenna Davis
*Assistant Examiner*—Jason Savage
*Attorney, Agent, or Firm*—Wood, Herron & Evans, L.L.P.

[57] ABSTRACT

A liner for a food product case is made from a non-woven textile mat which is non-absorbent to liquid but permeable to both air and liquid to permit circulation of liquid and cooled air through the liner and around the food items. Moreover, an upper surface of the mat includes a pattern of a non-skid medium, preferably a thermal expanding or puff ink to inhibit food items placed atop the liner from sliding downwardly along a sloped surface of the food case. Advantageously, the thermal expanding or puff ink is preferably applied through a silk screening process which enables highly detailed and multi-colored graphics including commercial advertisements to be applied to the mat and serve as a point of purchase display.

7 Claims, 1 Drawing Sheet

FOOD CASE LINER

BACKGROUND OF THE INVENTION

This invention relates to a liner, and more particularly to a liner for food product cases.

Many supermarkets and other retail or wholesale food stores use refrigerated cases for displaying perishable food items to self-service customers. Commonly, packaged meat, chicken and fish are arranged on a display surface in a refrigerated case. Likewise, fresh vegetables such as tomatoes, lettuce, beans or the like are arranged on a display surface of a refrigerated vegetable case which may include means to periodically mist or spray water on the vegetables to maintain their freshness.

Typically, the display surface of the food product cases of the type described is sloped or inclined downwardly toward the customer to provide for better access and viewing of the food items by the customer. One problem associated with the food product cases having a sloped display surface is that the food items thereon have a tendency to shift or slide toward the lower front edge of the food case. As a result, the food items in the case may have a tendency to accumulate at the lower front edge of the case and thereby minimize the number of products which are easily accessible and the visual effect of the displayed products because the products are in a pile at the front edge of the case.

It is well known to place perforate liners between the product display surface of food cases and the food items themselves to allow air and moisture to pass beneath the food items and to provide a cushion between the food and the case. Such known liners are fabricated from expanded PVC with polyester woven lace and as such have a tendency to absorb and retain moisture. The absorbency of known food case liners presents a potential health problem because the absorbent liner provides a host for the growth of bacteria which obviously should be avoided for products used in association with food items. As such, known food case liners present potentially significant health and safety problems and have proven to be ineffective in providing a proper surface for the arrangement and display of the food items in the food case.

SUMMARY OF THE INVENTION

It has therefore been a primary objective of this invention to provide an improved liner for food cases for use in supermarkets and other food wholesalers and retailers.

It has been a still further objective of this invention to provide such a liner which minimizes health and safety concerns.

It has been a still further objective to provide such a liner that permits chilled air of the refrigerated food case to circulate therethrough and chill the food items positioned on the liner.

These and other objectives of the invention have been attained by a food case liner which comprises a non-woven textile mat which is both non-absorbent to liquid and liquid and gas permeable to permit circulation of liquid and cooled air through the liner and around the food items supported thereon. As a result, the liner of the present invention does not absorb moisture as with known liners and does not provide a host for the growth and accumulation of bacteria as with known absorbent liners.

The liner according to this invention also includes a pattern of a high friction, non-skid medium affixed to an upper surface of the mat. In a presently preferred embodiment of the liner, the non-skid medium is a foamable ink such as water based thermal expanding ink or plastisol based puff ink. Foamable inks of this type have been utilized for many years in screen and other types of printing whereby the ink composition is applied to, for example, a T-shirt for raised, or decorative purposes. These types of inks expand or rise slightly as they are heat set or cured under elevated temperatures to provide a unique relief appearance. During the curing process, the ink puffs or rises in a vertical direction from the surface upon which it is applied so the final thickness of the ink is significantly greater after it has been cured.

Once the puff or thermally expanding ink is applied to the mat and cured, it provides a high friction non-skid upper surface to the liner. As a result, the food items placed on the liner atop the sloped or inclined display surface of the food case do not slide toward the lower front edge of the case and remain in position in the case for convenient access and viewing by the customer.

Another significant advantage of the present invention which utilizes the thermally expanding ink for the non-skid surface is that the location of the ink can be carefully controlled through a silk screening application process. Additionally, the requisite coefficient of friction and thickness of the non-skid medium can be obtained with the printing process. As a result, detailed, multi-colored high resolution patterns can be produced on the liner according to this invention. Such patterns preferably comprise commercial advertisements, logos, or other indicia to serve as point of purchase displays. Since the liner is positioned for convenient access and viewing by the customers, it has a unique advantage of providing an effective point of purchase display or advertisement in a location which is sure to gain the attention of the customers shopping for meat, vegetables or other food items.

As a result, the food case liner according to this invention serves the dual purposes of providing a safe, effective and functional liner to maintain the position of the food items on the sloped display surface of the food case while also offering a readily viewable and attractive advertising and display media for the food retailer, wholesaler, producer or supplier at the point of purchase.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
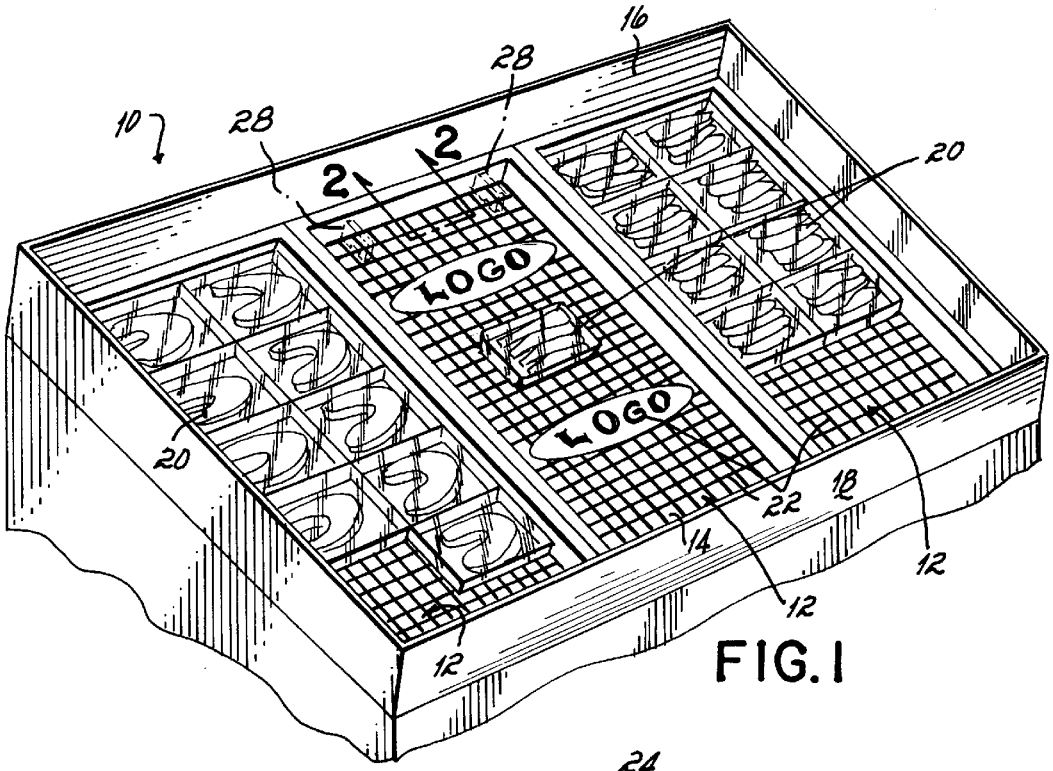
FIG. 1 is a perspective view of a food case partially broken away having a liner according to the present invention positioned on a sloped display surface of the case with food items positioned atop the liner.

A food product case 10 with a liner 12 positioned atop a sloped or inclined product display surface 14 is shown in FIG. 1. The case 10 may be a refrigerated case or a non-refrigerated case and is of the type that is typically found in supermarkets and retail or wholesale food stores.

The upper product display surface 14 of the case 10 is sloped downwardly from a back edge 16 of the case 10 toward a front edge 18 of the case 10 proximate the customer (not shown). Packaged food items 20 such as meat, fish, poultry or the like are positioned atop the liner 12 of the food product case 10 for display and convenient access to self-service customers. It will be appreciated that although packaged food items are shown in FIG. 1 that the present invention is easily susceptible to use with other food items, such as fresh vegetables, or non-food items. Food product cases for the display of fresh vegetables typically include a water mister (not shown) or other means for spraying water on the fresh vegetables.

Figure 2:
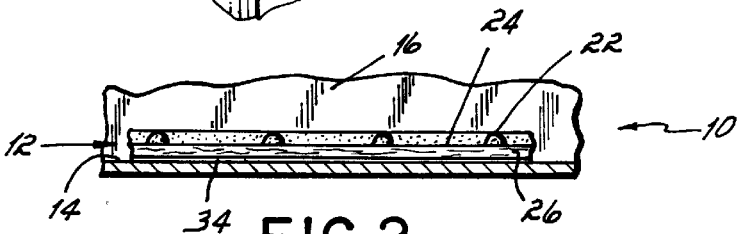
FIG. 2 is a cross-sectional view taken along line 2—2 of FIG. 1.

The liner 12 according to a presently preferred embodiment of the invention is positioned atop the product display surface 14 of the food case 10 and includes a pattern of a non-skid medium 22 affixed to an upper surface 24 of an underlying mat 26 as shown particularly in FIG. 2. The non-skid medium 22 is preferably raised with respect to the upper surface 24 of the mat 26 and may include a geometric pattern, a commercial advertisement, logo, or other indicia as shown in FIG. 1. Additionally, the non-skid medium 22 provides for an effective cushion between the display surface 24 of the food case 10 and the food items 20. The entire upper surface 24 of the mat 26 may or may not be covered by the non-skid medium 22 according to this invention. Because the liner 12 is positioned on the display surface 14 of the case 10 which is typically painted metal or a similarly slick surface, clips or other fasteners 28 may be secured to a back edge of the liner 12 and a wire or other structure in the case 10 to prevent the liner 12 from sliding downwardly along the slope to the front edge 18 of the case 10.

Advantageously, the non-skid medium 22 on the upper surface 24 of the mat 26 has a high coefficient of friction meaning a high resistance to slipping or sliding. As such, the food items 20 positioned atop the liner 12 are inhibited from sliding downwardly toward the front edge 18 of the food case 10 and can be maintained in an attractive and orderly arrangement in the food case 10 for display and access by the self-service customers.

In a presently preferred embodiment of the invention, the mat 26 is a spunlaid non-woven textile material which is non-absorbent to liquid and liquid and gas permeable to permit circulation of liquid and cooled air through the liner 12 and around the food items 20. While the mat 26 is preferably of a non-absorbent material, the mat may adsorb a certain amount of water by retaining it within the voids of the non-woven textile material. A material which has been found to be suitable for the mat 26 according to this invention is sold under the brand name Colback and is commercially available from Akzo Nobel Geosynthetics Company of Asheville, N.C. The Colback material is manufactured in 100, 120 and 150 gram per square meter products. This material has a liquid permeability rate of 200 gpm/ft$^2$ as tested according to ASTM Procedure D4491. Moreover, the mat 26 has an air permeability of 676 ft$^3$/minute as tested according to ASTM Procedure 737 and has less than 0.001% heavy metal contaminants as tested by ASTM Procedure USPXX11. In contrast, known food case liners have been tested to have a heavy metal content on the order of 0.033% according to the same testing procedure. The 120 gram per square meter product was used in the test procedures described herein.

The non-woven textile mat 26 according to a presently preferred embodiment is an isotropic bi-filament filter fiber of polyester strands encapsulated in a product known in the trade as "nylon 6". The filaments are thermally bonded and have a diameter on the order of ±37 microns. The mat 26 derives a significant amount of its strength from the nylon components of the nonwoven fibers. The mat material has been tested to have a breaking strength of 400 N according to DIN 53857 test and a resistance to tearing of 160 N according to DIN 53363 test. The mat 26 preferably includes voids which are supported by the strength of the nylon and which render the mat 26 permeable. The mat 26 not only passes large quantities of water and air therethrough but also accepts the temperature gradients likely to be experienced by the food product case liner 12.

Another advantageous feature of the presently preferred material for the mat 26 is that it possess sufficient stiffness so that it will not gather or bunch in use, for example at the front edge of the case 10. The stiffness (Gurley) has been tested to be 9.8 mN according to NEN 1842 test procedure. Preferably the mat 26 abuts against a toe strip (not shown) or other structure at the front edge of the case 10 and the mat 26 resists gathering or bunching due to its inherent stiffness. As a result, the fasteners may not be required to maintain the mat 26 in position. However, the preferred mat material is not so rigid that it can not be bent or folded to conform to the particular geometries of the underlying display surface 24, shelf or the like.

Figure 3:
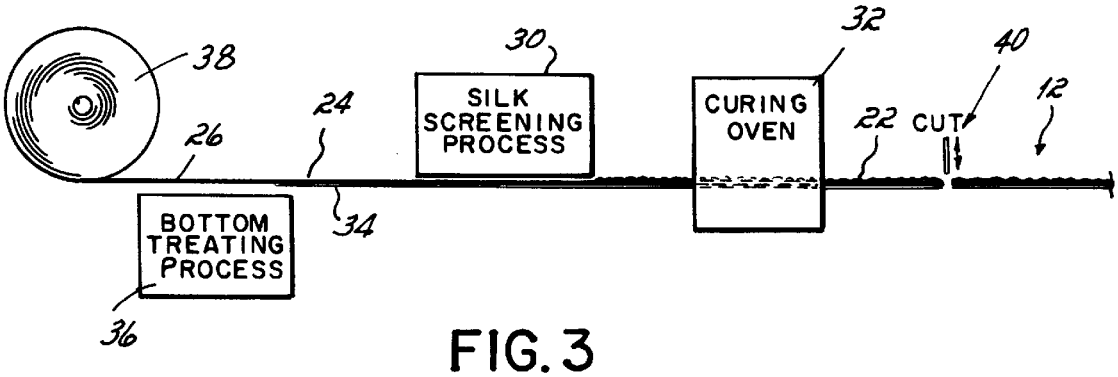
FIG. 3 is a schematic view of a presently preferred method of producing the food case liner according to this invention.

Preferably, the non-skid medium 22 affixed to the upper surface 24 of the mat 26 is a water based thermal expanding ink or a plastisol based puff ink. Most preferably, a water based thermal expanding ink commercially available from Eastern Color and Chemical Company of Greenville, S.C. and sold under the brand name Eccobrite Super Puff 7780 is used. Alternatively, 600 LF Series Puff Plastisol Ink which is commercially available from International Coatings Company, Inc. of Cerritos, Calif. may be used. Either of the preferred inks are preferably applied to the mat 26 through a silk screening process 30 as shown in FIG. 3. The silk screening process 30 is preferably a flat bed automated printing process capable of applying 17 different colored inks to the mat 26 by employing a Zimmer machine. Alternatively, a rotary screen printing apparatus as is commonly known in the industry can be used to apply up to two colors of ink to the mat 26.

The ink is preferably applied anywhere from 2 to 3 millimeters thick and after it is applied, it is dried and cured in an appropriate oven 32 or the like. During the curing process, the ink puffs or rises in a vertical direction from the mat 26 so that the final thickness of the pattern on the mat 26 can be anywhere from 5 millimeters to as much as one-eighth of an inch or so. The mat 26 thickness is preferably about 0.6 microns.

The present invention is particularly well adapted for forming complicated and aesthetically pleasing multi-color patterns. This is because the location of the ink can be carefully controlled by the silk screening application process 30 while at the same the requisite thickness of the ink can be obtained. By way of example, the ink is preferably applied with a soft pallet or puff pad with a reduced pressure on the squeegee to achieve a highly consistent puff during the curing or hardening process. A 65–75% Durometer having a bevel, sharp or rounded edge squeegee is preferably used. An 86 to 125 monofilament mesh is preferably used during the silk screening process 30 and any direct or indirect lacquer-proof emulsion may be employed. Use of a 35 to 60 micron capillary film has been found to provide best results. However, a thicker screen stencil will help to achieve sharper detail and a higher more consistent puff of ink.

Prior to the silk screening process 30, an adhesive or anti-friction coating 34 can be applied in a treatment process 36 to the bottom surface of the mat after it is unrolled from a roll 38 as shown in FIG. 3. The anti-friction coating 34 applied to the bottom surface of the mat 26 is useful to inhibit the mat 26 from sliding or moving during the silk screening process 30. Further, depending on the particular curing process employed, the bottom coating 34 preferably remains on the mat 26 once the liner 12 is produced so that when the liner 12 is positioned atop the inclined product display surface 14 it will not shift or slide and the clips or fasteners 28 as a result are optional. Preferably, the anti-friction bottom coating 34 is a polyvinyl alcohol compound such as Startex 1500 which is commercially available from Olympic Adhesives, Inc. of Norwood, Mass.

Preferably the ink is cured in an oven at 275° F. to 325° F. since the ink will not air dry. The optimum time/temperature parameters for the curing process will vary with the amount of ink deposited and the type of heat source used. Plastisol puff inks actually achieve proper curing once the innermost section of the ink reaches the prescribed temperature. Known food case liners could not be silk screen printed upon with thermal expanding ink because known liner materials cannot withstand the high temperature curing of the ink. Therefore, the high resolution ink graphics on the liner of this invention have heretofore been unknown for food case liners.

The final step in the production of the liner 12 according to one presently preferred embodiment of the invention as shown in FIG. 3 is sectioning the mat with a knife or other appropriate cutting mechanism 40. In presently preferred embodiments, the liner 12 is cut into 36×48 inch sections or produced in a roll of up to 150 linear feet and dispensed from the roll by the grocer, retailer, wholesaler or the like as required.

As a result of the silk screening process, the thermal expanding ink or plastisol puff ink enables the pattern atop the mat 26 to be a multi-color attractive point of purchase advertising display and may include intricate highly stylized multi-color graphics including commercial advertisements, logos or other indicia. Furthermore, the thermal expanding ink is a non-skid surface on the liner 12 which has been tested to have a coefficient of friction greater than 1.0 as determined by a James machine with a modified ASTM Method D2407 test. In comparison, a typical non-slip floor finish has a coefficient of friction between 0.5 to 0.8.

The liner 12 of the present invention not only provides a non-skid highly appealing surface for lining the food product case 10, the constituent parts of the liner 12, primarily the non-woven textile mat 26, does not absorb moisture but permits liquid and air to permeate therethrough to minimize the growth of bacteria or other such contaminants in the liner 12.

From the above disclosure of the general principals of the present invention and the preceding detailed description of preferred embodiments, those skilled in the art will readily comprehend the various modifications to which the present invention is susceptible. For example, the liner according to this invention may be employed in other environments in addition to food product cases. Therefore, I desire to be limited only by the scope of the following claims and equivalents thereof.

I claim:

1. A combination comprising:

a food product case for displaying food items to customers, the food product case having an inclined display surface for supporting the food items;

a non-woven textile mat which is non-absorbent to liquid and gas permeable and positioned on the inclined display surface; and a pattern of a non-skid medium affixed to an upper surface of the mat, the pattern of non-skid medium inhibiting the food items on top thereof from sliding across the upper surface of the mat on the inclined display surface.

2. The combination of claim 1 wherein the fibers of the mat are polyester strands encapsulated in nylon.

3. The combination of claim 1 wherein the pattern includes a commercial advertisement.

4. The combination of claim 1 wherein the non-skid medium is selected from the following: water based thermal expanding ink and plastisol based puff ink.

5. The combination of claim 1 wherein the non-skid medium has a coefficient of friction of greater than 1.0 and is raised with respect to the upper surface of the mat.

6. The combination of claim 1 further comprising:

a non-skid backing on a bottom surface of the mat to inhibit the mat from sliding with respect to the inclined display surface.

7. The combination of claim 1 further comprising:

fasteners to secure the mat relative to the food product case.

* * * * *